US012037035B2

(12) United States Patent
Haas et al.

(10) Patent No.: US 12,037,035 B2
(45) Date of Patent: Jul. 16, 2024

(54) COMMUNICATION SYSTEM AND METHOD

(71) Applicant: Transportation IP Holdings, LLC, Norwalk, CT (US)

(72) Inventors: Carl L. Haas, Walkersville, MD (US); Padam D. Swar, Clarksburg, MD (US)

(73) Assignee: Transportation IP Holdings, LLC, Norwalk, CT (US)

( * ) Notice: Subject to any disclaimer, the term of this patent is extended or adjusted under 35 U.S.C. 154(b) by 564 days.

(21) Appl. No.: 17/223,864

(22) Filed: Apr. 6, 2021

(65) Prior Publication Data

US 2021/0309270 A1 Oct. 7, 2021

Related U.S. Application Data

(60) Provisional application No. 63/005,662, filed on Apr. 6, 2020.

(51) Int. Cl.

*B61L 27/70* (2022.01)
*B61L 27/40* (2022.01)
*B61L 27/57* (2022.01)

(52) U.S. Cl.

CPC ..... *B61L 27/70* (2022.01); *B61L 27/40* (2022.01); *B61L 27/57* (2022.01)

(58) Field of Classification Search

CPC ..... B61L 27/70; B61L 27/40; B61L 27/57; B61L 15/0027; B61L 15/0054; B61L 15/0081

See application file for complete search history.

(56) References Cited

U.S. PATENT DOCUMENTS 5,267,473 A 12/1993 Bezos et al.
5,650,713 A 7/1997 Takeuchi et al.
6,227,625 B1 5/2001 Gaughan
(Continued)

FOREIGN PATENT DOCUMENTS

CA 2972412 A1 8/2016
CN 101170279 A 4/2008
(Continued)

OTHER PUBLICATIONS

Examination Report No. 1 for corresponding AU Application No. 2022201616 dated Mar. 9, 2022 (4 pages).
(Continued)

*Primary Examiner* — Russell Frejd
(74) *Attorney, Agent, or Firm* — K&L Gates LLP

(57) ABSTRACT

A system and a method includes a monitoring device disposed onboard a first vehicle of a vehicle system. The monitoring device may obtain information about one or more of the monitoring device, the first vehicle, the vehicle system, or a route along which the vehicle system moves. The system includes a communication system having one or more processors configured to wirelessly activate and communicate with the monitoring device. The communication system is configured to wirelessly activate the monitoring device by controlling the monitoring device to establish a communication link between the monitoring device and a control system disposed onboard another vehicle of the vehicle system. The communication system is separate from and disposed a distance away from the monitoring device and the vehicle system.

20 Claims, 2 Drawing Sheets

(56) References Cited

U.S. PATENT DOCUMENTS

| | | | | |
|---|---|---|---|---|
| 6,803,748 | B2 | 10/2004 | Peter | |
| 7,109,928 | B1 | 9/2006 | Thiele et al. | |
| 7,468,564 | B2 | 12/2008 | Crisafulli | |
| 7,769,509 | B2 | 8/2010 | Gaughan et al. | |
| 7,979,173 | B2 | 7/2011 | Breed | |
| 8,102,077 | B2 | 1/2012 | Neher | |
| 8,299,645 | B2 | 10/2012 | Muchow et al. | |
| 9,065,370 | B2 | 6/2015 | Ito et al. | |
| 9,083,861 | B2 | 7/2015 | Haas et al. | |
| 9,393,977 | B2 | 7/2016 | Kramer et al. | |
| 10,457,281 | B2 | 10/2019 | Brooks | |
| 11,277,727 | B1 * | 3/2022 | Samson | H04W 4/80 |
| 2003/0071467 | A1 | 4/2003 | Calley et al. | |
| 2010/0123314 | A1 | 5/2010 | Menke | |
| 2012/0191265 | A1 | 7/2012 | Keir | |
| 2014/0361540 | A1 | 12/2014 | Knight | |
| 2015/0105967 | A1 | 4/2015 | Skipp et al. | |
| 2016/0118786 | A1 | 4/2016 | Zhu et al. | |
| 2016/0208781 | A1 | 7/2016 | Kjær et al. | |
| 2016/0290318 | A1 | 10/2016 | Muik | |
| 2016/0355198 | A1 * | 12/2016 | Dulmage | B61L 27/70 |
| 2017/0101054 | A1 | 4/2017 | Dusane | |
| 2018/0041151 | A1 | 2/2018 | Turpin | |
| 2018/0166776 | A1 | 6/2018 | Ziegler et al. | |
| 2018/0210439 | A1 | 7/2018 | Brooks et al. | |
| 2019/0271991 | A1 * | 9/2019 | Dulmage | G08G 1/22 |
| 2019/0308647 | A1 * | 10/2019 | Dulmage | B61L 25/028 |
| 2020/0001857 | A1 | 1/2020 | Naylor et al. | |
| 2020/0001906 | A1 | 1/2020 | Bramucci et al. | |
| 2020/0189631 | A1 | 6/2020 | Gorman et al. | |
| 2021/0037341 | A1 * | 2/2021 | Joao | G07C 9/27 |
| 2022/0059935 | A1 | 2/2022 | Zhang et al. | |

FOREIGN PATENT DOCUMENTS

| | | | |
|---|---|---|---|
| CN | 103078615 | A | 5/2013 |
| WO | 2019133824 | A1 | 7/2019 |

OTHER PUBLICATIONS

Examination Report No. 3 for corresponding AU Application No. 2022201616 dated Jul. 18, 2023 (3 pages).

Examination Report No. 1 for corresponding AU Application No. 2022202434 dated Jul. 18, 2023 (5 pages).

Office Action for corresponding CA Application No. 3, 113,624 dated Mar. 2, 2022 (4 pages).

First Examination Report for Corresponding IN Application No. 202114014004 dated Jun. 17, 2022 (6 pages).

Analog Devices LTC3350, High Current Supercapacitor Backup Controller and System Monitor (10 pages).

Burr-Brown, 1.2A PWM High-Side Driver for Solenoids, Coils, Valves, Heaters, and Lamps (26 pages).

* cited by examiner

COMMUNICATION SYSTEM AND METHOD

CROSS-REFERENCE TO RELATED APPLICATIONS

This application claims priority to U.S. Provisional Application No. 63/005,662, filed Apr. 6, 2020, which is incorporated by reference herein in its entirety.

BACKGROUND

Technical Field

The subject matter described relates to vehicle monitoring systems and methods.

Discussion of Art

Vehicle monitoring devices may be coupled with vehicle systems as the vehicle systems move along routes. The monitoring device may monitor the vehicle system and/or the route along which the vehicle system moves. Before the vehicle system moves along the route, the monitoring device must be armed to, or associated with, a control system of the vehicle system. One technical problem of existing systems and methods is an inability to safely establish a communication link between the monitoring device disposed onboard one vehicle with the control system disposed onboard another vehicle of the vehicle system without an operator physically interacting with the monitoring device. For example, the operator may need to be close enough to the monitoring device to press one or more buttons on the monitoring device to arm the monitoring device with the control system of the same vehicle system before the vehicle system moves along the route. As another example, the operator may need to be close enough to the monitoring device to review or analyze information displayed by the monitoring device. The information may relate to a status of different systems of the vehicle system (e.g., propulsion system, energy system, or the like), diagnostic information about the vehicle system, the route, or the monitoring device, or the like.

However, being close enough to interact with and manipulate the monitoring device may require the operator to be placed in dangerous positions. In one example of the vehicle system being a rail vehicle system, the operator may need to stand on a railroad track in order to be close enough to interact with the monitoring device. Safety rules require operators to stand a certain distance away from vehicle systems, yet in order to arm the monitoring device with the control system, existing systems require the operators to physically press a button on the monitoring device. Standing on or between rails to directly access the monitoring device may be undesirable.

BRIEF DESCRIPTION

In one or more embodiments, a system includes a monitoring device disposed onboard a first vehicle of a vehicle system. The monitoring device may obtain information about one or more of the monitoring device, the first vehicle, the vehicle system, or a route along which the vehicle system moves. The system includes a communication system having one or more processors configured to wirelessly activate and communicate with the monitoring device. The communication system is configured to wirelessly activate the monitoring device by controlling the monitoring device to establish a communication link between the monitoring device and a control system disposed onboard another vehicle of the vehicle system. The communication system is separate from and disposed a distance away from the monitoring device and the vehicle system.

In one or more embodiments, a system includes an end-of-vehicle device that may be coupled with an exterior end of a first vehicle of a vehicle system. The end-of-vehicle device includes an output device configured to display information in a display arrangement about one or more of the end-of-vehicle device, the first vehicle, the vehicle system, or a route along which the vehicle system moves. The system includes a communication system having one or more processors configured to wirelessly activate and communicate with the end-of-vehicle device. The communication system is configured to wirelessly receive information from the end-of-vehicle device. The communication system includes an output device configured to display the information from the end-of-vehicle device in the same display arrangement as the output device of the end-of-vehicle device. The communication system is separate from and disposed a distance away from the end-of-vehicle device and the vehicle system.

In one or more embodiments, a method includes wirelessly activating and communicating with a monitoring device disposed onboard a first vehicle of a vehicle system. The monitoring device includes a display configured to display information about one or more of the monitoring device, the first vehicle, the vehicle system, or a route along which the vehicle system moves in a display arrangement. Information may be received from the monitoring device and displayed in the same display arrangement as the monitoring device.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to systems and methods that enable communication systems to remotely control one or more operations of monitoring devices. The communication system may establish a wireless communication link with the monitoring device, and may display information received from the monitoring device. In one or more embodiments, the communication system may display the information from the monitoring device in a same or similar display arrangement as information displayed by the monitoring device. The communication system may remotely control operations of the monitoring device disposed onboard one vehicle to arm or associate the monitoring device with a control system disposed onboard another vehicle of a vehicle system.

While some embodiments described herein relate to rail vehicle systems and positive vehicle control systems, not all embodiments of the inventive subject matter are restricted to rail vehicles or positive vehicle control systems. One or more embodiments of the inventive subject matter may relate to other types or models of vehicle systems, such as automobiles, trucks, buses, mining vehicles, marine vessels, aircraft (manned or unmanned, such as drones), agricultural vehicles, or other off-highway vehicles. Additionally, the vehicle systems may include two or more different types of vehicles that may operate as a common vehicle system and that may communicate with each other via an off-board database or off-board controller. The off-board controller may wirelessly communicate with the vehicle systems to control movement of the vehicle systems. For example, the vehicle system may comprise a rail vehicle that may communicate with an unmanned aerial vehicle via the off-board database, or an aircraft that communicates with a marine vessel.

Figure 1:
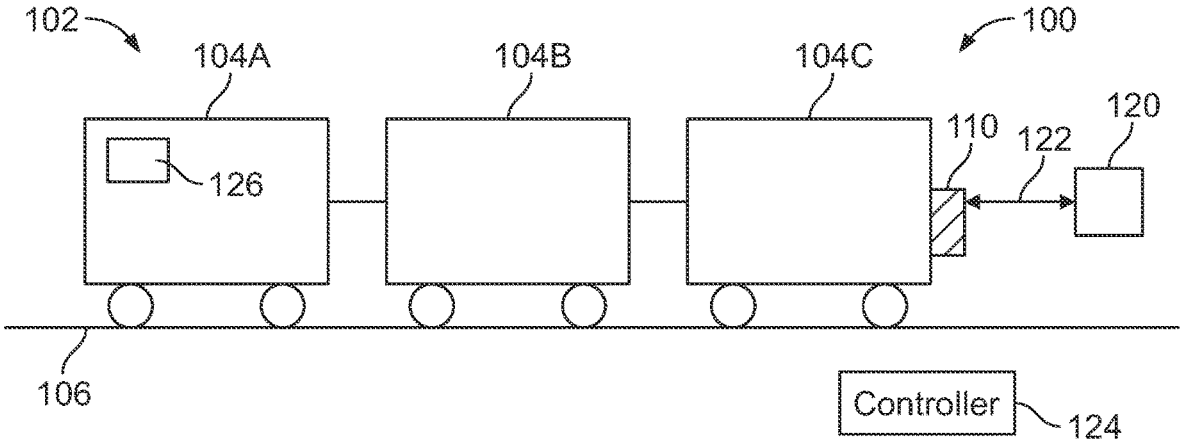
FIG. 1 schematically illustrates one example of a vehicle system.

FIG. 1 illustrates one example of a system 100 that includes a vehicle system 102, a monitoring device 110 coupled with the vehicle system, and a communication system 120 disposed off-board and separate from the vehicle system. The vehicle system can be a rail vehicle system, but optionally can be automobiles, trucks, buses, mining vehicles, marine vessels, aircraft, agricultural vehicles, or other off-highway vehicles. The illustrated vehicle system includes three vehicles, but optionally can be formed from two or more vehicles that may travel together (by being mechanically coupled or by being mechanically separate but communicating with each other to travel together, such as in a convoy). The vehicle system travels along a route 106, such as tracks, roads, highways, land-based paths, airborne paths, waterways, or the like.

At least one vehicle of the vehicle system includes a control system 126. In one or more embodiments, one or more of the vehicles may include a control system disposed thereon. The control system may be referred to as an onboard controller that can represent hardware circuitry that includes and/or is connected with one or more processors that perform operations described in connection with the control system. The control system can communicate with onboard and/or off-board components via a communication device (not shown) that may represent transceiving circuitry, one or more antennas, modems, or the like.

The control system may communicate with an off-board controller 124. The off-board controller can represent hardware circuitry that includes and/or is connected with one or more processors that perform operations of the off-board controller. In one or more embodiments, the off-board controller can communicate with the control system of the vehicle system to control or restrict movement of one or more vehicles of the vehicle system. For example, the off-board controller can communicate with the control system of the vehicle system to notify the vehicle system where the vehicle system is allowed to travel, how fast the vehicle system is allowed to travel, or the like.

In one embodiment, the off-board controller may represent a back-office server of a positive vehicle control (PVC) system. A PVC system is a control system in which a vehicle system is allowed to move, and/or is allowed to move outside a designated restricted manner (such as above a designated penalty speed limit), only responsive to receipt or continued receipt of one or more signals (e.g., received from off-board the vehicle) that meet designated criteria, e.g., the signals have designated characteristics (e.g., a designated waveform and/or content) and/or are received at designated times (or according to other designated time criteria) and/or under designated conditions. This is opposed to 'negative' vehicle control systems where a vehicle is allowed to move unless a signal (restricting movement) is received. The back-office server may be a vital or a non-vital system such that data stored, contained, maintained, communicated between, or the like, may be vital (e.g., protected) and/or non-vital (e.g., non-protected) data. Alternatively, the off-board controller represents another computerized system that communicates with vehicle systems described herein.

A monitoring device 110 is coupled with one of the vehicles of the vehicle system. In the illustrated embodiment, the monitoring device is coupled with a vehicle 104C. Additionally, the control system is disposed on another vehicle 104A. Optionally, the monitoring device may be coupled with a different vehicle, may be coupled with a vehicle having the control system, or any combination therein. The monitoring device may be referred to herein as a vehicle signaling and monitoring device, or an end-of-vehicle (EOV) device. The EOV device may monitor the vehicle system and/or the route along which the vehicle system moves. In one or more embodiments, the vehicle to which the monitoring device is coupled can be referred to as an end-of-train (EOT) vehicle or an end-of-vehicle (EOV) vehicle. The EOT device may be a transferrable device that may be moved from one vehicle to another vehicle that may change the designation of the respective vehicle from which the EOT device is removed, and the other vehicle where the EOT device is moved to may be identified as a new EOT vehicle.

Figure 2:
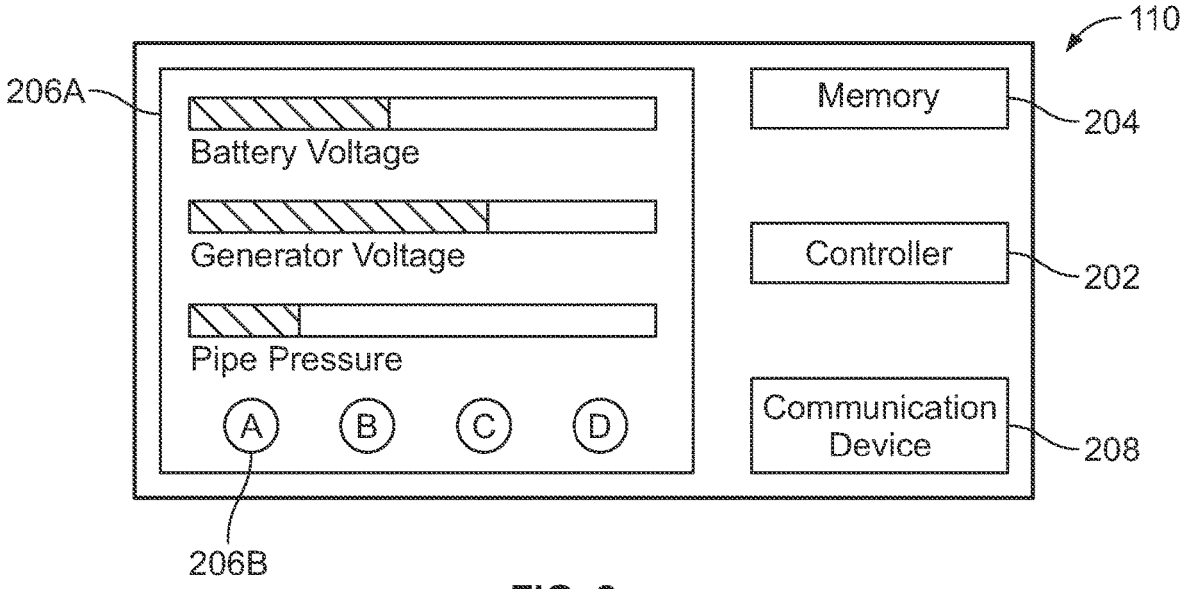
FIG. 2 illustrates a monitoring device in accordance with one embodiment.

FIG. 2 illustrates the monitoring device in accordance with one embodiment. The monitoring device includes a controller 202 that can represent hardware circuitry that includes and/or is connected with one or more processors that perform operations of the monitoring device. A memory 204 can store information about the monitoring device, information about the vehicle system, information about the route along which the vehicle system moves, or the like. Nonlimiting examples of the information that may be stored in the memory include an identification of the monitoring device, identification of each of the vehicles of the vehicle system, data collected by one or more sensors of the monitoring device (e.g., data related to the route, how the vehicle system is or has been operated as the vehicle system moves along the route), time stamps related to when the vehicle system moved passed wayside devices, moved from a first geospatial area into a different geospatial area, when the vehicle system was moving and when the vehicle system was stationary, or the like.

The monitoring device can include a communication device 208. The communication device can communicate with the control system, the off-board controller, the communication system, or the like. The communication device can represent transceiving circuitry, one or more antennas, modems, or the like. The communication device may receive and/or provide data signals to the control system, the off-board controller, the communication system, or the like.

The monitoring device can include an input/output device 206. The input/output device may be a display, touchscreen, monitor, speaker, light, or the like, that can receive input from an operator and can provide information to the operator. In the illustrated embodiment of FIG. 2, the monitoring device includes a display screen 206A that may be a touchscreen like a graphical user interface (GUI). The display screen indicates a status of different systems, elements, or components of the vehicle system. For example, the display screen shows an operator bar graphs indicating the status of battery voltage, generator voltage, and pipe pressure.

Additionally, the operator may interact with the display screen by selecting one or more different modes of display via inputs 206B. For example, selection of mode A may display one set of information related to the monitoring device and/or vehicle system. Optionally, selection of mode B may cause the display screen to display different information, such as information related to one or more previous trips of the vehicle system. Optionally, selection of mode C may cause the display screen to display a status of communication links between the monitoring device and the control system or any other system. Optionally, selection of mode D may cause the display screen to display any other information related to the monitoring device, the vehicle system, one or more vehicles of the vehicle system, the control system, one or more systems of the vehicle system (e.g., propulsion system, brake system, energy storage system, etc.), or the like. Optionally, the communication system may receive and display diagnostic information about the vehicle system, the monitoring device, the route, or the like. The information and configuration of the input/output device illustrated in FIG. 2 is for illustrative purposes only, and may have any alternative configuration, arrangement, or the like, that enables an operator to interact with the monitoring device.

In one or more embodiments, before the vehicle system starts to move along the route, a communication link must be established at least between the monitoring device and the control device onboard the other vehicle of the vehicle system. For example, the communication link may arm, bond, or otherwise connect the monitoring device with the control system of the vehicle system. One technical problem of existing systems and methods is an inability to establish the communication link without an operator physically interacting with the monitoring device. For example, the operator may press one or more buttons, a display screen, or the like, to generate and communicate a request from the monitoring device coupled with the first vehicle to establish a communication link with the control system onboard another vehicle of the vehicle system. Additionally or alternatively, in order to check the status and/or health of existing systems, the operator physically interacts with the monitoring device. For example, the operator may press a touchscreen or one or more buttons to request that the monitoring device display information obtained by the monitoring device, such as brake pipe pressure, battery voltage, generator voltage, or the like.

Figure 3:
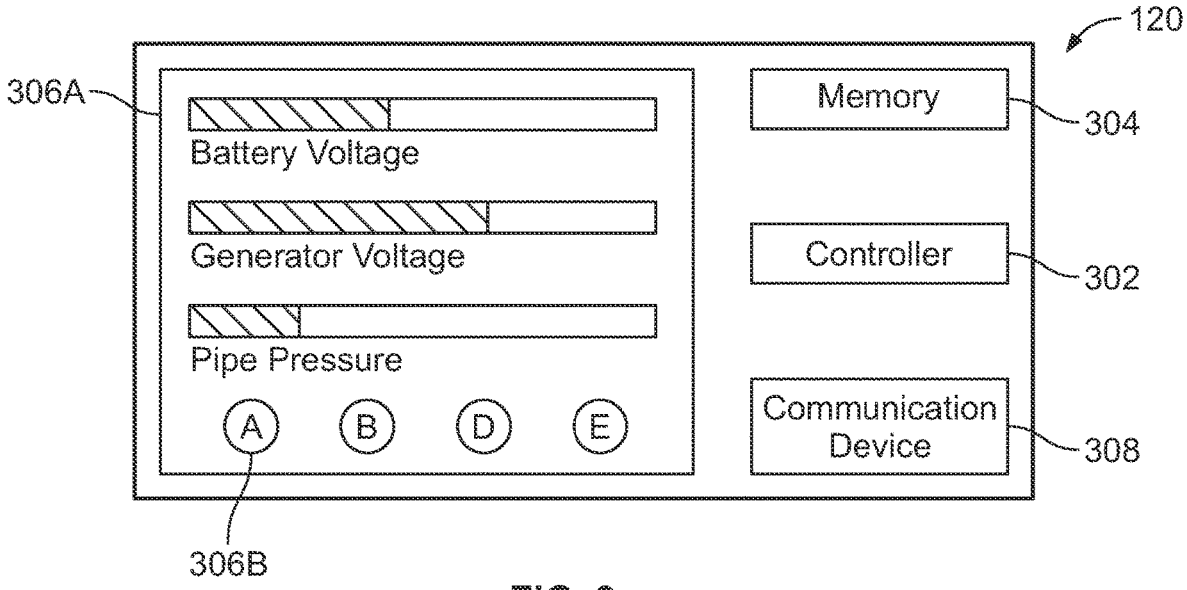
FIG. 3 illustrates a communication system in accordance with one embodiment.

The present invention includes the communication system 120 that solves at least these technical problems. FIG. 3 illustrates one embodiment of the communication system. The communication system can include one or more systems or devices, such as, but not limited to, controller 302 that can represent hardware circuitry that includes and/or is connected with one or more processors that perform operations of the monitoring device. A memory 304 can store information about the monitoring device, information about the vehicle system, information about the route along which the vehicle system moves, or the like.

The communication system can include a communication device 308 that can communicate at least with the communication device of the monitoring device. Optionally, the communication device of the communication system may communicate with the control system, the off-board controller, the communication system, or the like.

The communication device can represent transceiving circuitry, one or more antennas, modems, or the like. The communication device may receive and/or provide data signals to the control system, the off-board controller, the communication system, or the like. In one embodiment, the communication device of the communication system can interact with other systems via one or more communication types. Suitable communication types can include, but are not limited to, cellular networks (e.g., the Global System for Mobile Communications (GSM)), mesh networks using Ethernet standards, wireless communication protocols (e.g., Bluetooth), radio and shortwave communication types, or the like. In one or more embodiments, where two or more communication types are present, the communication device of the communication system may translate some or all of a data stream from one type to another. Similarly, different data protocols may be used. Such translation may allow the communication device of the communication system to act as a transference point for data transmission. The translation may allow for different types of equipment (e.g., first and second vehicles may each use communication types different from each other to communicate with each other via the communication system). The communication device may switch types, protocols, and/or communication pathways in response to delegation of signal or failure of one pathway. This may provide redundancy of communication by the communication system. In one embodiment, the communication device may decrypt, decompile, or disaggregate information, parse information, and send along all or part of a message (e.g., alone or combined with new data, or with encryption, or both). The communication device may be the same as or similar to other communication devices or communication systems described herein.

The communication system includes an input/output device 306. The input/output device may be a display, interface, touchscreen, monitor, speaker, light, or the like, that can receive input from an operator and can provide information to the operator. In one or more embodiments, the communication system wirelessly receives information from the monitoring device, and displays the information from the monitoring device in the same display arrangement as what is displayed on the monitoring device. For example, as illustrated embodiment of FIG. 3, the communication system includes a display screen 306A and inputs 306B that mimic, match, is in the same arrangement as, or the like, the display screen 206A and inputs 206B of the monitoring device. For example, the information shown on the monitoring device may be cast onto the display screen of the communication system in the same, or substantially the same arrangement, configuration, orientation, etc. For example, a user looking at the display of communication system would see or observe the same information and/or interface as the information and/or interface displayed on the monitoring device.

The communication system, that is separate from the monitoring device and/or the vehicle system, may control operation of the monitoring system, can display the same information displayed on the monitoring system, from a distance 122 away from the monitoring system. In an embodiment, the communication system may be disposed a distance of at least about 1 meter from the monitoring system. In another embodiment, the communication system may be disposed a distance of at least about 5 meters from the monitoring system. In another embodiment, the communication system may be disposed a distance between about 1 meter and about 50 meters from the monitoring system. In another embodiment, the distance between the communication system and the monitoring system may change while the communication system displays the same information as the monitoring system. For example, an operator may be operating a transferable communication system and may move to one or more different distances away from the vehicle system. For example, an operator may interact with the communication system to remotely control one or more operations of the monitoring device in the same or substantially the same manner as the operator would interact directly with the monitoring device.

In one or more embodiments, the communication system may wirelessly activate the monitoring device responsive to the communication system being within a threshold distance 122 of the monitoring device. For example, the monitoring device may have one or more devices that allow for short-range communication, such as Bluetooth, Near-field Communication, Wi-Fi, or the like. As one example, if the communication system is within fifty meters of the monitoring device, ten meters of the monitoring device, five meters of the monitoring device, three meters of the monitoring device, one meter of the monitoring device, a communication link may be established between the communication system and the monitoring device. In one or more embodiments, the communication system may confirm an identification of the monitoring device. For example, the communication system may be proximate two different monitoring devices, but only may want to wirelessly communicate with one instead of the other. In one or more embodiments, the communication system may need to be within a predetermined threshold distance away from the monitoring device before the communication system can establish a communication link with the monitoring device. Additionally, the communication system may confirm that the communication system has established the communication link with the correct monitoring device disposed on or coupled with the correct vehicle system.

The communication link between the communication system and the monitoring device may allow the communication system to wirelessly control one or more settings or operations of the monitoring device. The monitoring device and the communication system may wirelessly communicate via different communication protocols, such as Bluetooth, a cellular network, radio or shortwave communication types, or the like.

In one or more embodiments, the communication system may be a tablet or smartphone, an application of the tablet or smartphone, or may be any other device that includes a display and allows for wireless communication, such as short-range communication. The communication system may be a mobile device that may be transferable (e.g., automatically via a propulsion system of the communication system, manually by another device such as a drone, or manually such as by an operator) from one position to another. The monitoring device may wirelessly communication information with the mobile communication device. Optionally, the communication system may be a stationary device, such as one disposed at one or more positions along the route. For example, the stationary communication device may be a wayside device or may be coupled with a wayside device. The communication device may automatically (e.g., without operator input) establish a communication link with the monitoring device as the monitoring device moves with the vehicle system along the route, moves within a predetermined proximity to the communication system, or the like.

In one or more embodiments, the communication system may be controlled automatically, such as remotely by the controller of the communication system, to request, receive, and/or communicate information with the monitoring device. For example, the communication system may automatically remotely control one or more operations of the monitoring device. Optionally, the communication system may be manually controlled, such as by an operator directly interacting with the communication system. The communication device may display the information wirelessly received from the monitoring device in an arrangement that matches the display of information on the monitoring device. For example, an operator looking at the display on the communication system would believe that the communication system is showing the display of information shown on the monitoring device.

Optionally, the communication system may be manually controlled, such as by an operator remotely interacting with the communication system (e.g., from the off-board controller or back-office server). For example, a wireless communication link between the communication system and the back-office server may allow an operator positioned at the back-office server to remotely control operation of the communication system to one or more of wirelessly activate the monitoring device, to establish a communication link between the monitoring device and the control system of the vehicle system, to request and/or receive information from the monitoring device, to communicate information to the monitoring device, or the like.

Figure 4:
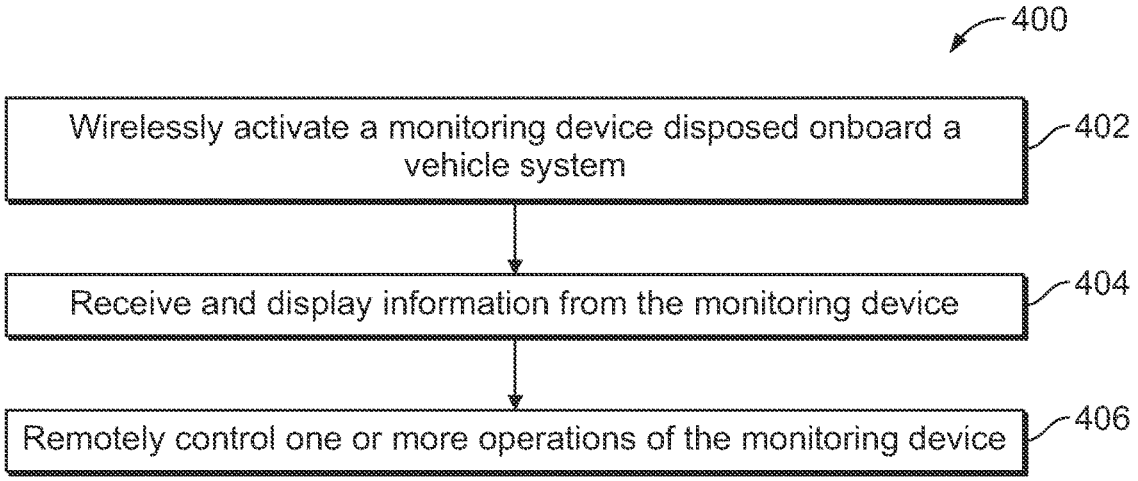
FIG. 4 illustrates a flowchart of a method of remotely controlling operation of a monitoring device via a communication system in accordance with one embodiment.

FIG. 4 illustrates a flowchart of a method of remotely controlling operation of a monitoring device via a communication system in accordance with one embodiment. At 402, a communication system wirelessly activates a monitoring device disposed onboard a vehicle system. For example, the communication system may establish a wireless communication link with the monitoring device. The communication system may remotely control operation of the monitoring device to establish a wireless link between the monitoring device and a control system disposed onboard another vehicle of the vehicle system. For example, the communication system may remotely control the monitoring device to arm, couple, associate, or the like, the monitoring device with the control system onboard the vehicle system.

At 404, the communication system may receive and display information from the monitoring device. In one or more embodiments, the monitoring device may include an output or display screen that may display information about the monitoring device, the vehicle system, or the like. The output or display screen may be a graphical user interface (GUI), such as a touchscreen, or the like. The communication system includes an output or display screen that displays the information receive from the monitoring device. In one or more embodiments, the communication system may display the information in the same, or substantially the same arrangement as is displayed by the monitoring device. For example, an operator of the communication system may observe the same information in the same arrangement, configuration, or orientation, as what is displayed on the monitoring device.

At 406, the communication system may remotely control operation of the monitoring device. For example, the communication system may remotely control the monitoring device to establish a new communication link with another system. Optionally, the communication system may direct the monitoring device to track or collect different information about the monitoring device, the control system, the vehicle system, the route, or the like. Optionally, the communication system may control the monitoring device to generate and/or communicate information with the communication system (e.g., at a given time, at predetermined time intervals, or the like).

In one or more embodiments of the subject matter described herein, a system includes a monitoring device disposed onboard a first vehicle of a vehicle system. The monitoring device may obtain information about one or more of the monitoring device, the first vehicle, the vehicle system, or a route along which the vehicle system moves. The system includes a communication system having one or more processors configured to wirelessly activate and communicate with the monitoring device. The communication system is configured to wirelessly activate the monitoring device by controlling the monitoring device to establish a communication link between the monitoring device and a control system disposed onboard another vehicle of the vehicle system. The communication system is separate from and disposed a distance away from the monitoring device and the vehicle system.

Optionally, the monitoring device may be an end-of-vehicle device.

Optionally, the communication system may wirelessly activate the monitoring device responsive to the communication system being within a threshold distance of the monitoring device.

Optionally, the communication system may wirelessly activate the monitoring device responsive to the communication system being within three meters of the monitoring device.

Optionally, the communication system may wirelessly receive information from the monitoring device.

Optionally, the communication system may wirelessly receive diagnostic information from the monitoring device that includes diagnostic information about one or more of the vehicle system, the monitoring device, the route along which the vehicle system moves, or a wayside device disposed off-board the vehicle system.

Optionally, the communication system may include an output device that may display the information wirelessly received from the monitoring device.

Optionally, the output device of the communication system may match a display shown on an output device of the monitoring device.

Optionally, the communication system may communicate information to the monitoring device and receive information from the monitoring device.

Optionally, the communication device may be a mobile device.

Optionally, the communication system may be a stationary device that may communicate with the vehicle system while the vehicle system moves along the route.

Optionally, an operator may wirelessly control one or more operations of the monitoring device via the communication device.

Optionally, the communication system may automatically control one or more operations of the monitoring device.

Optionally, the communication system may confirm an identification of the monitoring device.

In one or more embodiments of the subject matter described herein, a system includes an end-of-vehicle device that may be coupled with an exterior end of a first vehicle of a vehicle system. The end-of-vehicle device includes an output device configured to display information in a display arrangement about one or more of the end-of-vehicle device, the first vehicle, the vehicle system, or a route along which the vehicle system moves in a display arrangement. The system includes a communication system having one or more processors configured to wirelessly activate and communicate with the end-of-vehicle device. The communication system is configured to wirelessly receive information from the end-of-vehicle device. The communication system includes an output device configured to display the information from the end-of-vehicle device in the same display arrangement as the output device of the end-of-vehicle device. The communication system is separate from and disposed a distance away from the end-of-vehicle device and the vehicle system.

Optionally, the communication system may wirelessly activate the end-of-vehicle device responsive to the communication system being within a threshold distance of the end-of-vehicle device.

Optionally, the communication system may control the end-of-vehicle device to establish a wireless link between the end-of-vehicle device and a control system disposed onboard another vehicle of the vehicle system.

Optionally, the communication system may wirelessly activate the end-of-vehicle device by controlling the end-of-vehicle device to establish a communication link between the end-of-vehicle device and a control system disposed onboard another vehicle of the vehicle system.

In one or more embodiments of the subject matter described herein, a method includes wirelessly activating and communicating with a monitoring device disposed onboard a first vehicle of a vehicle system. The monitoring device includes a display configured to display information about one or more of the monitoring device, the first vehicle, the vehicle system, or a route along which the vehicle system moves in a display arrangement. Information may be received from the monitoring device and displayed in the same display arrangement as the monitoring device.

Optionally, wirelessly activating the monitoring device may include controlling the monitoring device to establish a wireless link between the monitoring device and a control system disposed onboard another vehicle of the vehicle system.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a monitoring device configured to be disposed onboard a first vehicle of a vehicle system, the monitoring device configured to obtain information about one or more of the monitoring device, the first vehicle, the vehicle system, or a route along which the vehicle system moves, the monitoring device including a display screen configured to display the information about the one or more of the monitoring device, the first vehicle, the vehicle system, or the route in a first arrangement; and a communication system comprising one or more processors configured to wirelessly activate and communicate with the monitoring device, wherein the communication system is configured to wirelessly activate the monitoring device by controlling the monitoring device to establish a communication link between the monitoring device and a control system disposed onboard another vehicle of the vehicle system, wherein the communication system is configured to receive the information from the monitoring device, the communication system including a display screen configured to display at least some of the information received from the monitoring device in the same first arrangement, wherein the communication system is separate from and disposed a distance away from the monitoring device and the vehicle system.

2. The system of claim 1, wherein the monitoring device is an end-of-vehicle device.

3. The system of claim 1, wherein the communication system is configured to wirelessly activate the monitoring device responsive to the communication system being within a threshold distance of the monitoring device.

4. The system of claim 1, wherein the communication system is configured to wirelessly activate the monitoring device responsive to the communication system being within three meters of the monitoring device.

5. The system of claim 1, wherein the communication system is configured to wirelessly receive the information from the monitoring device.

6. The system of claim 1, wherein the communication system is configured to wirelessly receive diagnostic information from the monitoring device that includes diagnostic information about one or more of the vehicle system, the monitoring device, the route along which the vehicle system moves, or a wayside device disposed off-board the vehicle system.

7. The system of claim 1, wherein the display screen of the communication system is configured to match a display shown on the display screen of the monitoring device, wherein the display screen of the communication system and the display screen of the monitoring device are configured to display the same information in the same first arrangement.

8. The system of claim 1, wherein the communication system is configured to communicate information to the monitoring device and receive information from the monitoring device.

9. The system of claim 1, wherein the communication device is a mobile device.

10. The system of claim 1, wherein the communication system is a stationary device configured to communicate with the vehicle system while the vehicle system moves along the route.

11. The system of claim 1, wherein an operator is configured to wirelessly control one or more operations of the monitoring device via the communication device.

12. The system of claim 1, wherein the communication system is configured to automatically control one or more operations of the monitoring device.

13. The system of claim 1, wherein the communication system is configured to confirm an identification of the monitoring device.

14. A system comprising:

an end-of-vehicle device configured to be coupled with an exterior end of a first vehicle of a vehicle system, the end-of-vehicle device comprising an output device configured to display information in a first display arrangement about one or more of the end-of-vehicle device, the first vehicle, the vehicle system, or a route along which the vehicle system moves; and a communication system comprising one or more processors configured to wirelessly activate and communicate with the end-of-vehicle device, wherein the communication system is configured to wirelessly receive information from the end-of-vehicle device, the communication system comprising an output device configured to display at least some of the information from the end-of-vehicle device in the same first display arrangement as the output device of the end-of-vehicle device such that the output device of the communication system and the output device of the end-of-vehicle device display at least some of the same information, wherein the communication system is separate from and disposed a distance away from the end-of-vehicle device and the vehicle system.

15. The system of claim 14, wherein the communication system is configured to wirelessly activate the end-of-vehicle device responsive to the communication system being within a threshold distance of the end-of-vehicle device.

16. The system of claim 14, wherein the communication system is configured to control the end-of-vehicle device to establish a wireless link between the end-of-vehicle device and a control system disposed onboard another vehicle of the vehicle system.

17. The system of claim 14, wherein the communication system is configured to wirelessly activate the end-of-vehicle device by controlling the end-of-vehicle device to establish a communication link between the end-of-vehicle device and a control system disposed onboard another vehicle of the vehicle system.

18. A method comprising:

a communication device wirelessly activating and communicating with a monitoring device configured to be disposed onboard a first vehicle of a vehicle system, the monitoring device comprising a display configured to display information about one or more of the monitoring device, the first vehicle, the vehicle system, or a route along which the vehicle system moves in a display arrangement;

receiving the information from the monitoring device; and displaying the information received from the monitoring device in the same display arrangement as the monitoring device.

19. The method of claim 18, wherein wirelessly activating the monitoring device includes controlling the monitoring device to establish a wireless link between the monitoring device and a control system disposed onboard another vehicle of the vehicle system.

20. The method of claim 18, further comprising wirelessly controlling one or more operations of the monitoring device via the communication device.

* * * * *